United States Patent [19]

Watanabe et al.

[11] 4,350,576

[45] Sep. 21, 1982

[54] METHOD OF PRODUCING A GRAPHITE INTERCALATION COMPOUND

[75] Inventors: Nobuatsu Watanabe, Nagaokakyo; Teruhisa Kondo, Toyonaka; Jiro Ishiguro, Suita, all of Japan

[73] Assignee: Toyo Tanso Co., Ltd., Osaka, Japan

[21] Appl. No.: 215,846

[22] Filed: Dec. 12, 1980

[30] Foreign Application Priority Data

Dec. 14, 1979 [JP] Japan ..... 54-161439

[51] Int. Cl.[3] ..... C25B 1/00; C25B 1/22

[52] U.S. Cl. ..... 204/101

[58] Field of Search ..... 204/91, 101, 93, 294, 204/291, 130

[56] References Cited

U.S. PATENT DOCUMENTS 3,814,699 6/1974 Baldieri et al. ..... 204/294

4,073,702 2/1978 Fleischman et al. ..... 204/294

4,120,774 10/1978 Hart ..... 204/294

*Primary Examiner*—R. L. Andrews

*Attorney, Agent, or Firm*—Armstrong, Nikaido, Marmelstein & Kubovcik

[57] ABSTRACT

A method of producing a graphite intercalation compound by intercalating a substance into graphite between layers thereof, characterized in that graphite particles are subjected to electrolysis in an electrolytic solution containing a substance capable of intruding into the interlayer spacings of the graphite while applying a load to the graphite particles in at least one direction to press all the graphite particles to the surface of an anode. According to the method, there can be obtained the desired porduct having a uniform and high quality.

6 Claims, 2 Drawing Figures

METHOD OF PRODUCING A GRAPHITE INTERCALATION COMPOUND

Figure 1:
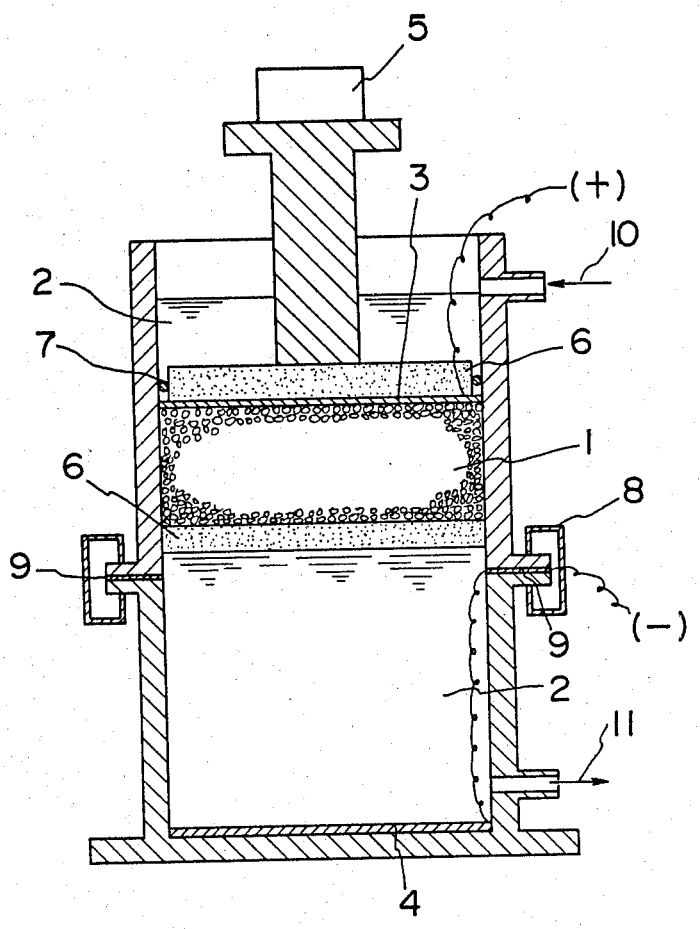

This invention relates to a novel method of producing a graphite intercalation compound. More particularly, the present invention is concerned with a method of producing a graphite intercalation compound by intercalating a substance into graphite between the layers thereof, characterized in that the graphite particles are subjected to electrolysis in an electrolytic solution containing a substance capable of intruding into the interlayer spacings of the graphite while applying pressure to the graphite particles in at least one direction to press all the graphite particles against the surface of an anode.

In general, graphite is a hexagonal system crystal of a packing structure in which hexagonal network faces, each formed by covalent bonding of each carbon atom with its adjacent carbon atoms, are stacked. The bonding between the layers which are stacked in a direction perpendicular to the hexagonal network face is very weak. Therefore, a graphite intercalation compound can be obtained by intercalating a substance capable of intruding into the interlayer spacings of graphite (hereinafter often referred to as "intruding substance") into graphite between the layers thereof.

Usually, the graphite intercalation compound is classified in three groups of compounds, namely, a non-conductive graphite intercalation compound, a conductive graphite intercalation compound and a residue compound. The conductive graphite intercalation compound is further classified in two groups of compounds, namely, an electrolytic intercalation compound and a non-electrolytic intercalation compound.

In preparing an electrolytic intercalation compound, an auxiliary means is used to cause a reaction of the intruding substance with the graphite to be promoted, because the intruding substance to be intercalated into the interlayer spacings of the graphite does not react by its own chemical nature with the graphite. As the auxiliary means, an external battery, as an external power source can be used. For example, Gerhart Henning has obtained graphite bisulfate, which is an electrolytic intercalation compound produced by electrolytic oxidation of the graphite employed as the anode in concentrated sulfuric acid (see *The Journal of Chemical Physics,* Vol. 19, No. 7, July 1951, pp. 922–929).

Further, an intercalation compound which has an identical structure with that of the electrolytic intercalation compound can be obtained by the use of an appropriate oxidizer, instead of the external battery, as an oxidation promotor together with an intruding substance. For example, as disclosed in U.S. Pat. No. 3,404,061, graphite bisulfate or graphite nitrate can be obtained by dipping graphite particles in an oxidative mixture of concentrated sulfuric acid, as the intruding substance, and concentrated nitric acid, a nitrate, chromic acid, potassium chromate, potassium dichromate, a chlorate, perchloric acid and/or the like as an oxidizing agent. Also, fuming nitric acid can be utilized, as a material capable of functioning both as the intruding substance and the oxidizing agent (in this instance, nitrogen dioxide is supposed to act as the oxidizing agent), or graphite particles can be dipped in an oxidative mixture of concentrated nitric acid, as the intruding substance, and potassium chlorate, potassium permanganate and/or the like, as the oxidizing agent.

When the graphite intercalation compound, as mentioned above, is heated at a high temperature, for example, at 600°–1,300° C., the graphite intercalation compound is expanded in a direction perpendicular to the faces of the layers of graphite, that is, in a direction of c-axis to obtain an expanded graphite having extremely low bulk density. The expanded graphite has excellent characteristics inherent of graphite, such as high thermal resistance, lubricity, chemical resistance and the like. Further, the expanded graphite can be easily formed into a shaped product having good flexibility by subjecting it alone or together with a suitable binder, such as a phenolic resin, to compression molding. Therefore, the expanded graphite is very useful as a raw material for producing sealing articles, such as gaskets and packings.

In the conventional method of producing the electrolytic graphite intercalation compound by electrolytic oxidation of graphite, the diffusion resistance of the intruding substance is large due to the insufficient mutual contact of the graphite particles and, hence, the reaction velocity is reduced and the reaction tends to be non-uniform, thus causing the production of a product of uniform quality to be difficult. For this reason, there is commercially adopted a method of producing the same kind of graphite intercalation compound as that of the electrolytic graphite intercalation compound, which method comprises treating graphite with an oxidative medium. However, the above-mentioned commercially adopted method has various drawbacks. For example, a large amount of concentrated acid and, in some cases, a poisonous metal-containing oxidizing agent is used in the method. Therefore, there is a danger to the workers. Further, there is a problem of selection of a material for the apparatus to be used in manufacturing the product. Still further, a large amount of alkali is required to neutralize the waste acid discharged from the process. Still further, there is a possibility of causing environmental pollution due to acidic gas ($SO_2$ and/or sulfuric acid mist), nitrogen oxides ($NO_x$) and chromium. It goes without saying that there is required a large amount of expenditure for disposing the poisonous materials and preventing environmental pollution. In addition, there is a trouble that when the product and the electrolyte are separated by means of a centrifugal separator, the centrifugation cannot be carried out before the concentrated acid is diluted due to the properties of the material used for making the centrifugal separator.

Accordingly, it is an object of the present invention to provide a method of producing a graphite intercalation compound having uniform and high quality, which method also eliminates the troubles and problems of the conventional methods.

It is another object of the present invention to provide a method of producing a graphite intercalation compound, characterized in that graphite is electrolyzed in an electrolytic solution having a comparatively low concentration so that the operation can be easily carried out without encountering any troubles inevitably accompanying the conventional method, and that at least part of the used electrolytic solution and the washings obtained in the process of water-washing of the product can be recycled for re-use as a part of the electrolytic solution so that the method is economic and material-saving.

Figure 2:
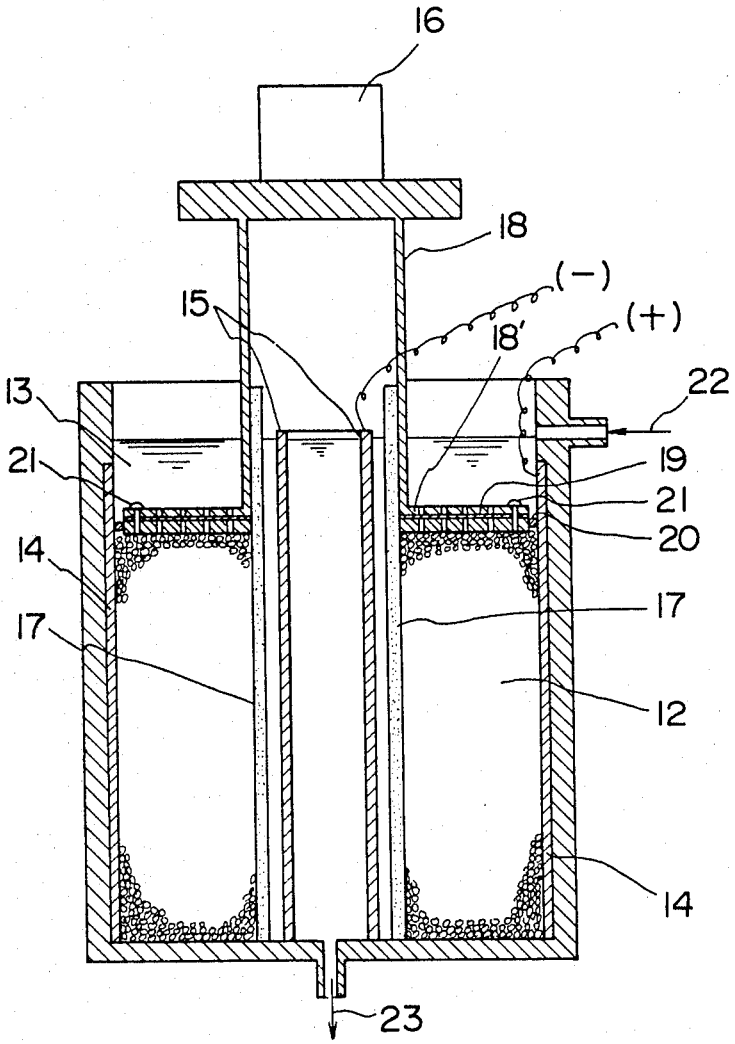

The foregoing and other objects, features and advantages of the present invention will be apparent to those skilled in the art from the following detailed description taken in connection with the accompanying drawings in which:

FIG. 1 is a vertical cross-sectional view of one form of the apparatus for practicing the method of the present invention; and FIG. 2 is a vertical cross-sectional view of another form of the apparatus for practicing the present invention.

In one and a principal aspect of the present invention, there is provided a method of producing a graphite intercalation compound comprising electrolyzing (using an electrolytic cell including a cathode, an anode and an anode chamber adapted to accomodate therein graphite particles) graphite particles in an electrolytic solution containing a substance capable of intruding into the interlayer spacings of graphite thereby to intercalate said substance into the interlayer spacings of graphite, characterized in that graphite particles are subject to electrolysis while applying pressure by means of a load to the graphite particles accomodated in the anode chamber in at least one direction to press all the graphite particles against the surface of the anode. In another aspect of the present invention, there is provided a method of the character described above, characterized in that at least part of a used electrolytic solution obtained by the electrolysis and a washing obtained by water-washing the graphite intercalation compound obtained by the electrolysis is recycled, after a substance capable of intruding into the interlayer spacings of graphite is replenished to adjust the concentration of the used electrolytic solution and the washing if required, for re-use as an electrolytic solution.

The essential feature of the present invention resides in that the graphite particles accomodated in the anode chamber are electrolyzed while applying pressure by means of a load to the graphite particles accomodated in the anode chamber in at least one direction to press all the graphite particles against the surface of the anode. Accordingly, the mutual contact of the graphite particles is improved, and not only does it become easy to treat the waste acid but also the operation can be carried out at low cost. In addition, there can be eliminated the problems of environmental pollution due to acidic gas, $NO_x$ and chromium. Thus, many advantages can be attained by the method of the present invention.

A detailed explanation of the method of producing a graphite intercalation compound according to this invention will be made, referring to FIGS. 1 and 2. The direction in which pressure by means of a load is applied to the graphite particles may be any direction in so far as all the graphite particles are pressed against the surface of anode. In order to give an illustrative explanation, two forms of the apparatus or electrolytic cell are shown in FIGS. 1 and 2.

Referring to FIG. 1, the graphite particles 1 are accomodated in an anode chamber defined by two liquid-permeable partition plates 6 (for example, glass filter) which are capable of resisting a load applied to the graphite particles. One of the partition plates 6 is closely attached to a porous anode plate 3 which allows the electrolytic solution to pass through. In FIG. 1, the electrolytic cell further comprises a cathode plate 4, an O-ring 7, a clamping member 8, and a double packing 9. The electrolytic cell body is divided into two portions so that a lead wire can be provided between the double packing 9. However, the electrolytic cell body is not required to be divided into two portions provided that the lead wire can be brought out through the side wall. A weight 5 is placed in such a manner that the load is applied in the direction perpendicular to the surface of the anode plate 3 and over the bulk of the graphite particles through the upper partition plate 6 and the anode plate closely attached thereto, so that all the graphite particles are pressed against the lower surface of the anode plate 3. The electrolytic solution 2 is introduced as an anolyte from an inlet shown by an arrow 10 and discharged as a catholyte from an outlet shown by another arrow 11.

Referring to FIG. 2, graphite particles 12 are accomodated, in the form of a bulk, in an anode chamber provided with an anode cylinder 14 and defined by a liquid-permeable cylindrical diaphragm 17, which is capable of resisting a load to be applied to the graphite particles, and a pressing plate formed at the lower end of a cylindrical support 18 which is provided for supporting the bed of a weight 16. A pressing plate 18' is arranged so that a liquid permeable cloth 19 is held between two plates provided with a plurality of through-holes and then secured by a retaining means 21. The electrolytic cell shown in FIG. 2 is provided with a cathode cylinder 15 of a net structure and an O-ring 20. In the electrolytic cell, a weight 16 serves to apply a load in the direction parallel to the surface of the anode cylinder 14 and then on the bulk of the graphite particles through the pressing plate 18' formed at the lower end of the cylindrical support 18. Consequently, all the graphite particles are pressed against the surface of the anode cylinder. The electrolytic solution 13 is introduced from an inlet shown by an arrow 22 as an anolyte and discharged from an outlet shown by another arrow 23. As described, the electrolytic oxidation of the graphite is carried out while pressing all the graphite particles against the surface of the anode. In the electrolytic oxidation, the lower limit of the load is usually 10 g/cm$^2$, preferably 30 g/cm$^2$, though it varies according to the specific gravity of the electrolytic solution and the particle size of the graphite particles. The upper limit of the load is usually 5 Kg/cm$^2$, and preferably 100 g/cm$^2$. When a load of more than 5 Kg/cm$^2$ is applied to the graphite particles, there is not any unfavorable effect on the formation of a graphite intercalation compound, but there is required an increased resistivity of an apparatus to the load, and therefore, too heavy a load is not economical. In a factory, a load is usually produced utilizing air pressure or hydraulic pressure.

In the present invention, the particle size of the graphite particles is not critical, but may generally be 20–150 mesh (Tyler).

As Examples of the intruding substance, there can be mentioned $BF_3(CH_3COOH)_2$, $CF_3COOH$, $H_2F_2$, $H_3PO_4$, $H_3AsO_4$, $HClO_4$, $HNO_3$ and the like. However, $H_2F_2$ and $HClO_4$ are generally not so preferable due to generation of gas when the graphite intercalation compound is heated to obtain an expanded graphite. However, they still may be useful for graphite intercalation compounds used for other purposes. Since the concentration of the graphite intercalation compound in the final product is equilibrated with the concentration of the electrolytic solution, it is preferred that the concentration of the intruding substance-containing electrolytic solution is high. The higher the concentration of the electrolytic solution, the more smooth the reaction. However, it is to be noted that a high concentration such as 95% or more, which is required in the method of producing a graphite intercalation compound by the treatment of graphite with chemicals, is not necessary for the method of the present invention. The lower limit of the concentration of the intruding substance in the electrolytic solution varies depending on the kind of the intruding substance, but may generally be 1-3 mols/-liter, preferably 3 mols/liter or more. The most preferred intruding substances are sulfuric acid and nitric acid. In the case of sulfuric acid, the concentration of the electrolytic solution is 30% by weight or more, preferably 50% by weight or more. In the case of nitric acid, the concentration of the electrolytic solution is 20% by weight or more, preferably 30% by weight or more. By the use of the above-mentioned concentrations of the electrolytic solution, it is possible to obtain graphite hydrogensulfate or graphite nitrate having a uniform and high quality.

The electric current density of the anode is suitably up to 500 mA/cm$^2$ and the electrolysis must be carried out at an anode electric current density of less than that mentioned-above. In order to obtain an intercalation compound with a high current efficiency, the current density is suitably 50 mA/cm$^2$ or less. Room temperature is suitable as an electrolytic reaction temperature. According to the kind of intruding substance used, however, control of the temperature is necessary to reduce volatilization of the intruding substance in the electrolytic solution because the temperature rises with the progress of the electrolysis. In order to prevent the rise of the temperature and to continue the electrolysis at a constant temperature, it is desirable to circulate the electrolytic solution through a cooler by means of a circulation pump.

A more desirable intercalation compound having a uniform quality can be obtained if an alternating current of 0.1-100 Hz is applied after completion of the electrolytic oxidation, thereby increasing the effect of the present invention.

In another aspect of the present invention, at least part of the used electrolytic solution and the washing obtained from the washing step of the graphite intercalation compound, is recycled for re-use. The used electrolytic solution and/or the washings (which is obtained in the earlier stage of the washing step and still includes the intruding substance at high concentration) are desirably re-used as the electrolytic solution by replenishing them with the intruding substance to adjust the concentration of the used electrolytic solution and the washings to the predetermined value, and therefore the utilization efficiency of the intruding substance can be increased. This recycling not only eliminates the necessity of a large amount of a neutralizing material, but also prevents environmental pollution, leading to great advantages. The concentration of the intruding substance in the washings for recycling is determined according to the production amount of the intercalation compound and the manufacturing cost therefor. Further, it is to be noted that an electrolytic solution having a comparatively low concentration can be used in the method of the present invention so that it is possible to recycle and re-use the used electrolytic solution and/or the washings. In the aforementioned conventional method in which graphite is treated with a chemical by dipping, a treating liquid should have a high concentration and, therefore, recycling for re-use of the used electrolytic solution and/or washings is difficult to achieve.

As described, according to the method of the present invention, the graphite intercalation compound having homogeneity can be advantageously obtained, overcoming difficulties inevitably accompanying the conventional dipping method.

The method according to the present invention has such an advantage that there may be used an electrolytic solution having a low concentration of the intruding substance when compared with that of the treating solution to be used in the conventional dipping method, so that it is possible to recycle and re-use the used electrolytic solution and the washings. Further, in the present invention, it is not required to additionally use strong oxidizing agents which cause various problems, and the reaction velocity can be electrically maintained at a predetermined value without regard to the concentration of the electrolytic solution and temperature while providing the graphite intercalation compound having a uniform and high quality. Furthermore, it should be noted that in the method of the present invention there is no need of such a complicated operation that the anode chamber is rotated.

The present invention will be illustrated with reference to the following Examples which should not be construed as limiting the scope of the present invention.

EXAMPLE 1

Using an electrolytic cell as shown in FIG. 1, 100 g of Madagascar-produced graphite particles (bulk density of 0.65 g/cm$^3$) having a particle size of 42 to 80 mesh (Tyler) and a peak of the particle size distribution at 60 mesh were accommodated in a cylindrical anode chamber having an inner diameter of about 10 cm and provided with two glass filter-made partition plates. By means of a liquid-permeable pressing plate composed of a platinum-made perforated circular anode plate and one of the above-mentioned two partition plates, a load of 30 g/cm$^2$ was applied to the graphite particles. A cathode chamber was provided with a platinum-made cathode plate. A 50% aqueous sulfuric acid solution as an electrolytic solution was introduced into the electrolytic cell.

Thereafter, while circulating the electrolytic solution by means of a circulation pump and flowing a current constantly having a current density of 40 mA/cm$^2$ for 7 hours, the graphite particles were subjected to electrolysis. In this instance, while the voltage was 2.3 V at the initial stage, at the final stage the voltage was elevated to 4.4 V, the electric resistance increased from 1.15Ω to 2.20Ω and the temperature of the electrolytic solution increased from 11° C. to 38.5° C.

After the electrolytic oxidation, the product was sufficiently washed with water and dried at 95° C.±5° C. The graphite bisulfate thus produced had a bulk density of 0.35 g/cm$^3$. When the product was heated at 1,000° C. for 1 minute, there was obtained an expanded graphite having a bulk density of 0.004 g/cm$^3$. This means that the expansion rate was 163 times.

EXAMPLE 2

Using an electrolytic cell as shown in FIG. 2, 100 g of Madagascar-produced graphite particles (bulk density of 0.65 g/cm$^3$) having a particle size of 42 to 80 mesh and a peak of the particle size distribution at 60 mesh were accomodated in a cylindrical anode chamber having an inner diameter of about 10 cm and provided with a titanium-made anode plate. By means of a liquid-permeable pressing plate which is airtightly, vertically movable along the periphery of an unglazed cermic-made partition cylinder having therein a titanium-made perforated cylindrical cathode, a load of 60 g/cm$^2$ was applied to the graphite particles. A 30% aqueous nitric acid solution as an electrolytic solution was introduced into the electrolytic cell. While circulating the electrolytic solution by means of a circulation pump so that the temperature of the electrolytic solution was maintained at 25° C. during the flowing of current, current constantly having a current density of 50 mA/cm$^2$ was flowed for 6 hours, thereby to electrolytically oxidize the graphite particles. In the course of the electrolysis, the voltage changed from 2.1 V to 4.5 V and the electric resistance changed from 1.1Ω to 2.15Ω.

After the electrolytic oxidation, the product was sufficiently washed with water and air-dried. The graphite nitrate thus produced had a bulk density of 0.4 g/cm$^3$. When the product was heated at 1,000° C. for 1 minute, there was obtained an expanded graphite having a bulk density of 0.006 g/cm$^3$. This means that the expansion rate was 108 times.

EXAMPLE 3

Using Madagascar-produced graphite particles (bulk density of 0.65 g/cm$^3$) having a particle size of 42 to 80 mesh and a peak of the particle size distribution at 60 mesh, the electrolytic oxidation was conducted in the same manner as in Example 1. After completion of the electrolytic oxidation, the electrolytic solution was separation-recovered from the product by means of a centrifugal separator. The resulting graphite intercalation compound was sufficiently washed with water and dried at 90° C., whereupon the bulk density was measured. The product was heated at 1,000° C. for 1 minute to obtain an expanded graphite. The bulk density of the expanded graphite was measured. The expansion rate was obtained from the bulk density ratio.

Using the used electrolytic solution recovered by the centrifugation, the electrolytic oxidation of graphite particles was conducted in the same manner as in Example 1. Similar procedures were repeated five times. The concentration of the electrolytic solution (i.e. concentration of sulfuric acid) was measured, after every electrolytic oxidation, by titration with a 1 N aqueous sodium hydroxide solution. The results are shown in Table 1.

TABLE 1

| Run No. | Concentration of electrolytic solution, wt % | Bulk density: Product | Bulk density: After heat-expansion | Expansion rate, times |
|---|---|---|---|---|
| 1 | 50.0 | 0.36 | 0.004 | 163 |
| 2 | 49.4 | 0.38 | 0.004 | 163 |
| 3 | 48.9 | 0.40 | 0.005 | 130 |
| 4 | 48.5 | 0.39 | 0.004 | 163 |
| 5 | 47.9 | 0.41 | 0.005 | 130 |
| 6 | 47.4 | 0.41 | 0.005 | 130 |

As is apparent from Table 1, according to the present invention, even if an intruding substance is replenished, the electrolytic solution used in the method of this invention can be used repeatedly to give graphite bisulfate without any substantial change in bulk density and expansion rate.

What is claimed is:

1. A method of producing a graphite intercalation compound in an electrolytic cell having a cathode, an anode and an andoe chamber adapted to accommodate graphite particles therein, which comprises electrolyzing graphite particles in the anode chamber in an aqueous electrolytic solution containing a substance capable of intruding into the interlayer spacings of graphite, thereby intercalating said substance into the interlayer spacings of graphite, wherein the electrolyzing is carried out at a current density of less than 500 mA$^2$/cm$^2$ and while applying a pressure to the graphite particles accommodated in the anode chamber in at least one direction so as to press the graphite particles against the surface of the anode.

2. A method according to claim 1, wherein said pressure is 10 g/cm$^2$ to 5 kg/cm$^2$.

3. A method according to claim 2 wherein said pressure is 30 g/cm$^2$ to 100 g/cm$^2$.

4. A method according to any of claims 2, 3 or 1 wherein said substance capable of intruding into the interlayer spacings of graphite is sulfuric acid or nitric acid.

5. A method according to any of claims 1 or 2 including recycling a solution comprising at least part of used aqueous electrolytic solution and washings obtained by water-washing the graphite intercalation compound obtained by the electrolysis.

6. A method according to claim 5, wherein the concentration of the substance capable of intruding into the interlayer spacings of the graphite in the recycled solution is adjusted for re-use as an aqueous electrolytic solution by addition of said substance.

* * * * *